US009669256B2

(12) United States Patent
Wu

(10) Patent No.: US 9,669,256 B2
(45) Date of Patent: Jun. 6, 2017

(54) GAIT TREAD SIMULATION FITNESS EQUIPMENT

(71) Applicant: STRENGTH MASTER FITNESS TECH. CO., LTD., Changhua County (TW)

(72) Inventor: Shu-yao Wu, Changhua County (TW)

(73) Assignee: Strength Master Fitness Tech. Co., Ltd., Puxin Township (TW)

( * ) Notice: Subject to any disclaimer, the term of this patent is extended or adjusted under 35 U.S.C. 154(b) by 0 days.

(21) Appl. No.: 15/099,053

(22) Filed: Apr. 14, 2016

(65) Prior Publication Data

US 2016/0263428 A1 Sep. 15, 2016

Related U.S. Application Data

(63) Continuation-in-part of application No. 14/659,087, filed on Mar. 16, 2015, now abandoned.

(30) Foreign Application Priority Data

Mar. 13, 2015 (TW) ..... 104108038 A

(51) Int. Cl.

| | |
|---|---|
| ***A63B 22/00*** | (2006.01) |
| ***A63B 22/06*** | (2006.01) |
| ***A63B 23/035*** | (2006.01) |
| ***A63B 21/00*** | (2006.01) |

(52) U.S. Cl.

CPC .... *A63B 22/0017* (2015.10); *A63B 21/00069* (2013.01); *A63B 21/158* (2013.01); *A63B 22/001* (2013.01); *A63B 22/0023* (2013.01); *A63B 22/0664* (2013.01); *A63B 23/03575* (2013.01); *A63B 2022/0676* (2013.01); *A63B 2022/0682* (2013.01); *A63B 2225/09* (2013.01)

(58) Field of Classification Search

USPC ..... 482/51–57

See application file for complete search history.

(56) References Cited

U.S. PATENT DOCUMENTS

| | | | | | |
|---|---|---|---|---|---|
| 5,788,610 | A * | 8/1998 | Eschenbach | A63B 22/001 | 482/51 |
| 5,792,027 | A * | 8/1998 | Gvoich | A63B 22/001 | 482/51 |
| 5,876,307 | A * | 3/1999 | Stearns | A63B 22/001 | 482/51 |
| 5,910,072 | A * | 6/1999 | Rawls | A63B 21/0053 | 482/51 |
| 6,004,244 | A * | 12/1999 | Simonson | A63B 21/153 | 482/51 |
| 6,036,622 | A * | 3/2000 | Gordon | A63B 21/154 | 482/51 |
| 6,135,926 | A * | 10/2000 | Lee | A63B 22/001 | 482/51 |

(Continued)

*Primary Examiner* — Stephen Crow

(74) *Attorney, Agent, or Firm* — Wang Law Firm, Inc.

(57) ABSTRACT

Gait tread simulation fitness equipment is provided, which utilizes a multi-linkage mechanism disposed on a main body and a suspending side frame to make an action track of a pedal to match the natural gait tread well. In addition, the relative position of the movable pivot can be adjusted to obtain different exercise modes for training different muscle groups, so as to achieve the objective of exercise training.

10 Claims, 13 Drawing Sheets

(56) References Cited

U.S. PATENT DOCUMENTS

| | | | | |
|---|---|---|---|---|
| 7,582,043 | B2 * | 9/2009 | Liao | A63B 22/001 482/51 |
| 7,972,248 | B2 * | 7/2011 | Liao | A63B 22/001 482/51 |
| 8,403,815 | B2 * | 3/2013 | Liao | A63B 22/001 482/51 |
| 9,067,094 | B2 * | 6/2015 | Chang | A63B 22/001 |
| 2009/0069158 | A1 * | 3/2009 | Hsu | A63B 22/0664 482/52 |

* cited by examiner

GAIT TREAD SIMULATION FITNESS EQUIPMENT

CROSS-REFERENCE TO RELATED APPLICATION

This application is a continuation-in-part of U.S. patent application Ser. No. 14/659,087, filed on Mar. 16, 2015, in the United States Patent and Trademark Office, which claims benefit of Taiwan Patent Application No. 104108038, filed on Mar. 13, 2015, in the Taiwan Intellectual Property Office, the disclosures of which are incorporated herein its entirety by reference.

BACKGROUND OF THE INVENTION

1. Field of the Invention

This application relates to gait tread simulation fitness equipment which is able to adjust and change the position of the pivot through the configuration of the linkage mechanism. As a result, the pedal is able to be actuated correspondingly to human's natural gait treads and matches the ergonomics while different muscle groups are trained so as to achieve the objective of exercise training.

2. Description of the Related Art

At present, the exercise type of the conventional gait tread fitness equipment is lacking in freedom due to structural limitations, and it thus results that users are not able to adjust the range of gait tread or the exercise type. Furthermore, the existing gait tread fitness equipment is still incapable of simulating the natural gait tracks perfectly, resulting that each joint of the lower limbs of the user may suffer from the sport injury easily due to the sudden impact after a long-term usage.

The traditional gait training apparatus applies the action of the linkage mechanism to enable the pedal disposed at the tread rod performing an elliptical closed track. Nonetheless, how to avoid the exercise track causing the technical problems such as length of long and short axis are not in an optimal ratio, the gait tread tracks are not consistent, meniscus gait track and the operation speed cannot be maintained in an adequate situation, and so on, is the problem in urgent need.

As far as the slope simulation is concerned, the current common exercise type is to use an actuator to adjust the inclined angle of the apparatus. It, however, needs greater power consumption, and the actuator and the related components may get damage easily owing to overuse. Consequently, the technical problem has to be further improved.

In conclusion, the inventor of the present disclosure has been mulling the aforementioned technical problems over, and then designs gait tread simulation fitness equipment which is applied to overcome the existing drawbacks so as to promote the industrial applicability.

SUMMARY OF THE INVENTION

In view of the aforementioned technical problems, the objective of the present disclosure provides gait tread simulation fitness equipment which applies the theory of the topology mechanism to choose the optimal type of the kinematic chain, so as to match the exercise track to facilitate the action track of the pedal being closer to the natural gait tread.

In view of the aforementioned technical problems, the objective of the present disclosure provides gait tread simulation fitness equipment which applies the arrangement of the suspending side frame and the suspending rod to improve the technical problems concerning that the arrangement of the conventional components such as slide rail, roller, and so on may get damage easily owing to overuse.

In view of the aforementioned technical problems, the objective of the present disclosure provides gait tread simulation fitness equipment applying a simple adjustment apparatus which is able to effectively adjust the exercise track so as to promote the flexibility of the exercise track.

In view of the aforementioned technical problems, the objective of the present disclosure provides gait tread simulation fitness equipment which applies the adjustment apparatus to adjust the length of the linkage mechanism or the position of the pivot so as to change the length of the long axis of the exercise track and to fit into different ranges of the gait treads.

In view of the aforementioned technical problems, the objective of the present disclosure provides gait tread simulation fitness equipment which applies the adjustment apparatus to adjust the length of the linkage mechanism or the position of the pivot so as to enable the exercise track performing various the inclined angles and to demonstrate diverse types of resisting forces to achieve the objective of exercise training in the slope simulation.

In view of the aforementioned technical problems, the objective of the present disclosure provides gait tread simulation fitness equipment which simulates different levels of slope to train the different muscle groups so as to achieve the objective of exercise training.

In view of the aforementioned technical problems, the objective of the present disclosure provides gait tread simulation fitness equipment which applies the arrangement and modification of the linkage to promote the flexibility of the exercise track and to match the natural gait tread which corresponds to the ergonomics, such that the legs may be able to do exercise conveniently while avoid the sport injury due to the sudden impact.

In view of the aforementioned technical problems, the objective of the present disclosure provides gait tread simulation fitness equipment which has the exercise track that fits into the natural gait tread. As a result, user's ankle joints, keen joints, hip joints and the other lower limbs' joints are able to avoid the damage caused by the sudden impact, and the risk of the sport injury can be decreased greatly.

In accordance with the aforementioned objectives, the present disclosure provides gait tread simulation fitness equipment which may include a main body, a plurality of suspending side frames and a plurality of guiding mechanisms. The main body may have a support frame, and a central stand may be disposed at a front end of the support frame and may have a first pivot and a second pivot. The plurality of suspending side frames may be respectively disposed at two sides of the main body and each suspending side frame may be disposed with a suspending pivot. The plurality of guiding mechanisms may be respectively disposed at two sides of the central stand. Each guiding mechanism may include a swing rod, a tread rod, a triple-joint link and a suspending rod. The swing rod may be pivotally connected to one end of the first pivot, one end of the tread rod may be pivotally connected to the swing rod, the other end of the tread rod may be disposed with a pedal, a first joint of the triple-joint link may be connected to one end of the second pivot, a second joint of the triple-joint link may be connected to the tread rod, one end of the suspending rod may be pivotally connected to a third joint of the triple-joint link, and the other end of the suspending rod may be pivotally connected to the suspending pivot. When the tread rod is reciprocating, the triple-joint link may be driven by the tread rod to go around the second pivot so as to facilitate the pedal actuating along a gait track.

Preferably, the triple-joint link may further include a stretching apparatus adjusting a length of the triple-joint link.

Preferably, the suspending rod may further include a length adjustment apparatus adjusting a length of the suspending rod.

Preferably, the triple-joint link may further include a position adjustment apparatus adjusting a relative position of the third joint of the triple-joint link.

Preferably, the suspending rod may further include a position adjustment apparatus adjusting a relative position of the suspending pivot.

In accordance with the aforementioned objectives, the present disclosure provides gait tread simulation fitness equipment which may include a main body, a suspending side frame, a rotation mechanism and a guiding mechanism. The main body may have a support frame, and a central stand may be disposed at a front end of the support frame and may have a first pivot. Two suspending side frames may be respectively disposed at two sides of the main body and each suspending side frame may be disposed with a suspending pivot. In practice, the suspending side frame may include a vertical rod, a horizontal rod or a combination thereof. For example, the vertical rod may be disposed vertically at the rear end of the support frame, and the horizontal rod may extend forwardly to connect to the central stand.

The rotation mechanism having two active members may be disposed at two sides of the first pivot correspondingly by 180° and rotated about the first pivot respectively. Two guiding mechanisms may be connected pivotally at two sides of the central stand respectively, each guiding mechanism may include a tread rod and a suspending rod, the active member of the rotation mechanism and the suspending rod that are at the same side may be connected by the tread rod. One end of the suspending rod may be connected pivotally to the suspending pivot, the other end of the suspending rod and the tread rod may be connected pivotally to a movable pivot, and a pedal disposed on the tread rod. When the pedal is treaded, the pedal is actuated along a closed track to enable the guiding mechanism being drawn back and forth, wherein a distance of the suspending pivot relative to the movable pivot is adjusted, or a distance of the movable pivot relative to the pedal is changed to facilitate the closed track matching a natural gait tread.

Preferably, the gait tread simulation fitness equipment of the present disclosure may further include a linkage unit having a triple-joint link and a double-joint link, wherein a Stephenson six-bar linkage may be comprised of the linkage unit, the rotation mechanism and the guiding mechanism.

According to the aforementioned objectives, the present disclosure further provides gait tread simulation fitness equipment which may include a main body, a suspending side frame and a guiding mechanism. The main body may have a support frame, and a central stand may be disposed at a front end of the support frame and may have a first pivot and a second pivot. Two suspending side frames may be respectively disposed at two sides of the main body and each suspending side frame may be disposed with a suspending pivot. In practice, the suspending side frame may include a vertical rod, a horizontal rod or a combination thereof. For example, the vertical rod may be disposed vertically at the rear end of the support frame, and the horizontal rod may extend forwardly to connect to the central stand.

Two guiding mechanisms may be respectively disposed at two sides of the central stand, each of the guiding mechanisms may be disposed at the first pivot and the suspending pivot that are at the same side to form a constrained kinematic chain. Each guiding mechanism may include a crank, a swing rod, a triple-joint link, a tread rod and a suspending rod. Wherein the crank is connected to the first pivot, the swing rod is connected pivotally to the second pivot and extends to form a handle. One end of the suspending rod may be connected pivotally to the suspending pivot, and the other end of the suspending rod and the tread rod may be connected pivotally to a movable pivot. The triple-joint link may be respectively connected to the crank, the swing rod and the tread rod, the triple-joint link and the suspending rod may be connected by the tread rod, and a pedal may be disposed on the tread rod to facilitate the pedal actuating along a gait track.

Preferably, the tread rod may further include a first adjustment apparatus adjusting a length of the tread rod or a relative position of the movable pivot so as to further change an aspect of the gait track. The first adjustment apparatus may include a single-stroke stretching apparatus, a multiple-stroke stretching apparatus, or a linear actuator.

Preferably, the suspending rod may further include a second adjustment apparatus and a third adjustment apparatus. The second adjustment apparatus may adjust a length of the suspending rod so as to further change an aspect of the gait track, and the third adjustment apparatus may adjust a relative position of the suspending pivot.

With these and other objects, advantages, and features of the disclosure that may become hereinafter apparent, the nature of the disclosure may be more clearly understood by reference to the detailed description of the disclosure, the embodiments and to the several drawings herein.

BRIEF DESCRIPTION OF THE DRAWINGS

Hereinafter, embodiments of the present disclosure will be described in detail with reference to the accompanying drawings so that those skilled in the art to which the present disclosure pertains can realize the present disclosure, wherein.

DETAILED DESCRIPTION OF THE PREFERRED EMBODIMENTS

Hereinafter, embodiments of the present disclosure will be described in detail with reference to the accompanying drawings so that those skilled in the art to which the present disclosure pertains can realize the present disclosure. As those skilled in the art would realize, the described embodiments may be modified in various different ways, all without departing from the spirit or scope of the present disclosure.

The exemplary embodiments of the present disclosure will be understood more fully from the detailed description given below and from the accompanying drawings of various embodiments of the disclosure, which, however, should not be taken to limit the disclosure to the specific embodiments, but are for explanation and understanding only.

Figure 1:
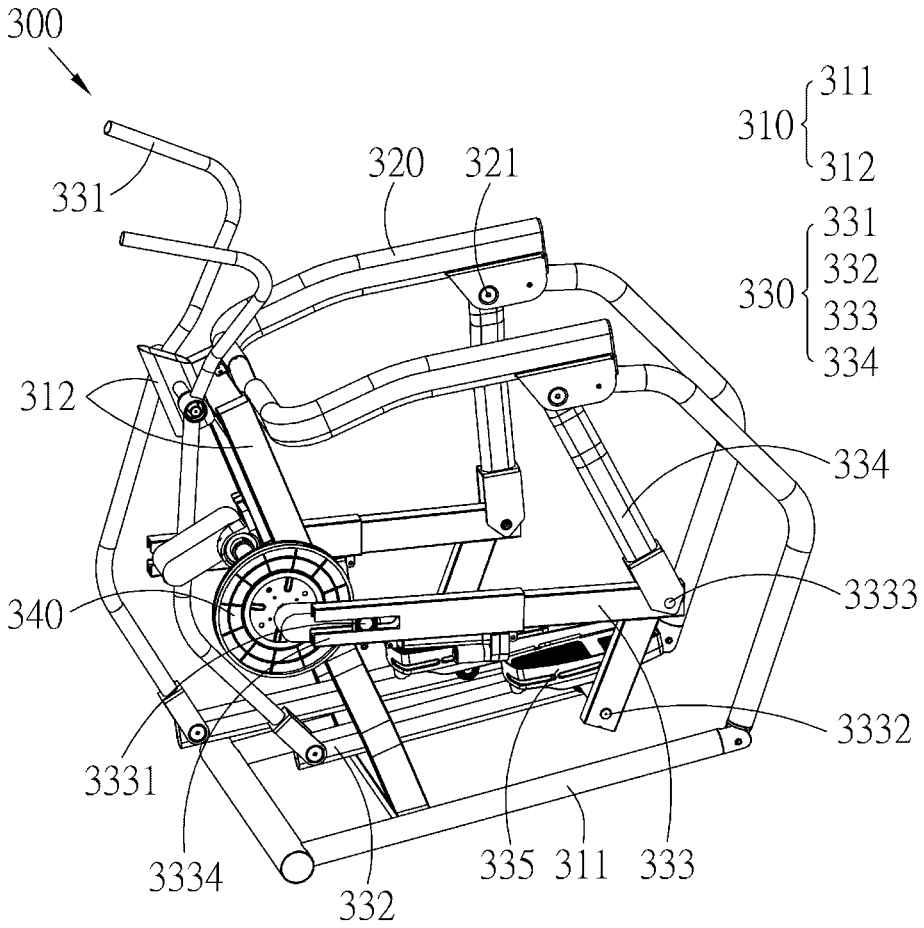
FIG. 1 is the first schematic diagram of the first embodiment of gait tread simulation fitness equipment of the present disclosure.
Figure 2:
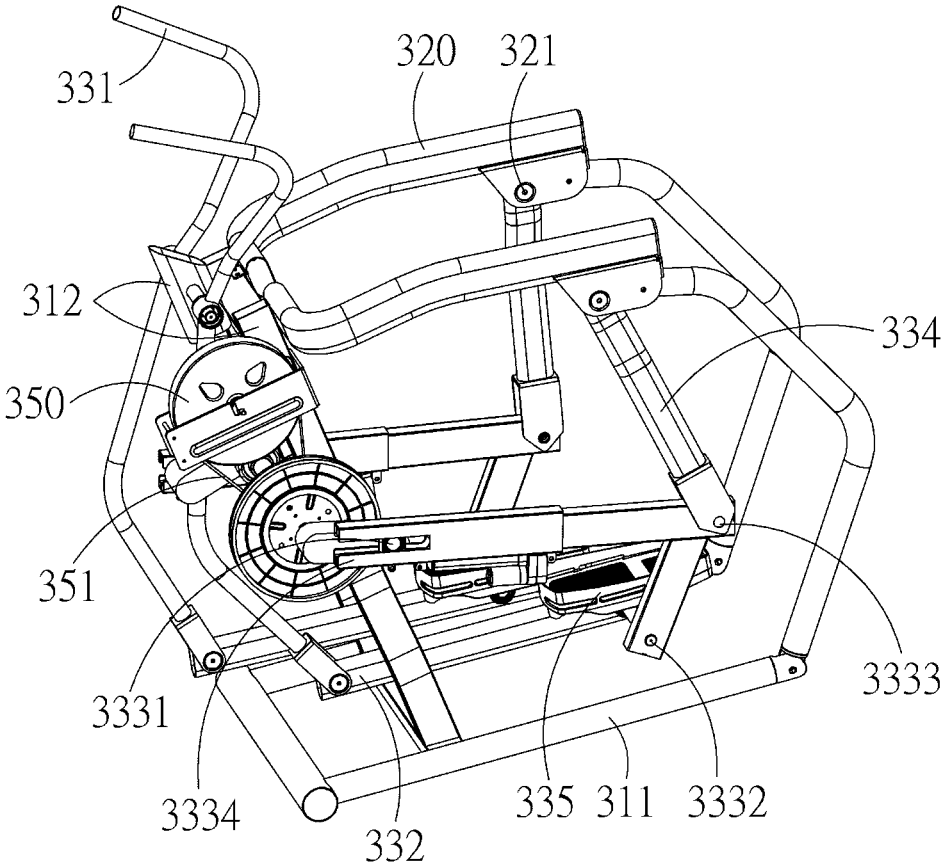
FIG. 2 is the second schematic diagram of the first embodiment of gait tread simulation fitness equipment of the present disclosure.

Please refer to FIG. 1 and FIG. 2, which are the first schematic diagram of the first embodiment of gait tread simulation fitness equipment of the present disclosure and the second schematic diagram of the first embodiment of gait tread simulation fitness equipment of the present disclosure, respectively. As shown in the figures, the gait tread simulation fitness equipment 300 includes a main body 310, a plurality of suspending side frames 320 and a plurality of guiding mechanisms 330. The main body 310 has a support frame 311, and a central stand 312 is disposed at a front end of the support frame 311 and has a first pivot 3121 and a second pivot 3122. The plurality of suspending side frames 320 are respectively disposed at two sides of the main body 310, and each suspending side frame 320 is disposed with a suspending pivot 321. The plurality of guiding mechanisms 330 are respectively disposed at two sides of the central stand 312. Each guiding mechanism 330 includes a swing rod 331, a tread rod 332, a triple-joint link 333 and a suspending rod 334. The swing rod 331 is pivotally connected to one end of the first pivot 3121, one end of the tread rod 332 is pivotally connected to the swing rod 331, the other end of the tread rod 332 is disposed with a pedal 335, a first joint 3331 of the triple-joint link 333 is connected to one end of the second pivot 3122, a second joint 3332 of the triple-joint link 333 is connected to the tread rod 332, one end of the suspending rod 334 is pivotally connected to a third joint 3333 of the triple-joint link 333, and the other end of the suspending rod 334 is pivotally connected to the suspending pivot 321. When the tread rod 332 is reciprocating, the triple-joint link 333 is driven by the tread rod 332 to go around the second pivot 3122 so as to facilitate the pedal 335 actuating along a gait track.

Specifically, the gait tread simulation fitness equipment 300 of the present disclosure includes the main body 310, the plurality of suspending side frames 320, the plurality of guiding mechanisms 330 and a flywheel mechanism 340. The main body 310 has the support frame 311 and the central stand 312. The central stand 312 is disposed at a front end of the support frame 311 and has the first pivot 3121 and the second pivot 3122. The plurality of suspending side frames 320 are respectively disposed at two sides of the main body 310, and each suspending side frame 320 is disposed with a suspending pivot 321. Each suspending side frames 320 also includes a vertical rod, a horizontal rod or a combination thereof. The suspending side frame 320 may be designed according to the actual requirements such as shape design, supporting strength, and so on. In addition, the plurality of guiding mechanisms 330 are respectively disposed at two sides of the central stand 312. Each guiding mechanism 330 includes the swing rod 331, the tread rod 332, the triple-joint link 333 and the suspending rod 334. The swing rod 331 is pivotally connected to one end of the first pivot 3121 for facilitating the user to hold. One end of the tread rod 332 is pivotally connected to the swing rod 331, the other end of the tread rod 332 is disposed with the pedal 335, the first joint 3331 of the triple-joint link 333 is connected to one end of the second pivot 3122, the second joint 3332 of the triple-joint link 333 is connected to the tread rod 332, one end of the suspending rod 334 is pivotally connected to the third joint 3333 of the triple-joint link 333, and the other end of the suspending rod 334 is pivotally connected to the suspending pivot 321.

When using the gait tread simulation fitness equipment 300, the user holds the swing rod 331 by hands and steps the pedal 335 by feet, and swings a plurality of swing rods 331 back and forth while treads the pedal 335 back and forth, so that the tread rod 332 reciprocates. Next, when the tread rod 332 is reciprocating, the triple-joint link 333 is driven by the tread rod 332 to go around the second pivot 3122 so as to facilitate the pedal 335 actuating along a gait track.

To be more precise, the gait tread simulation fitness equipment 300 is further disposed with the flywheel mechanism 340. The flywheel mechanism 340 is pivotally disposed at one end of the second pivot 3122. When the tread rod 332 is reciprocating, the triple-joint link 333 is driven by the tread rod 332 to go around the second pivot 3122 so as to move the flywheel mechanism 340. Here, the flywheel mechanism 340 is used to store the inertial motion to overcome the dead point of the motion of the tread rod 332 so as to promote the entire operation of the gait tread simulation fitness equipment 300 accurately.

Furthermore, the triple-joint link 333 of the present disclosure further includes a stretching apparatus 3334 used to adjust a length of the triple-joint link 333. The stretching apparatus 3334 includes a single-stroke stretching apparatus, a multiple-stroke stretching apparatus or a linear actuator. As a result, the user may use the stretching apparatus 3334 to stretch or to shorten a relative position between one end of the suspending rod 334 and the second pivot 3122. Thereby, the movement track of the tread rod 332 is modified to simulate the motion mode of different aspects.

Moreover, a position adjustment apparatus (not shown) is disposed on the triple-joint link 333, so that a relative position of the third joint 3333 of the triple-joint link 333 is adjusted through the position adjustment apparatus. Here, the position adjustment apparatus may be a gear wheel and rack set.

Figure 3:
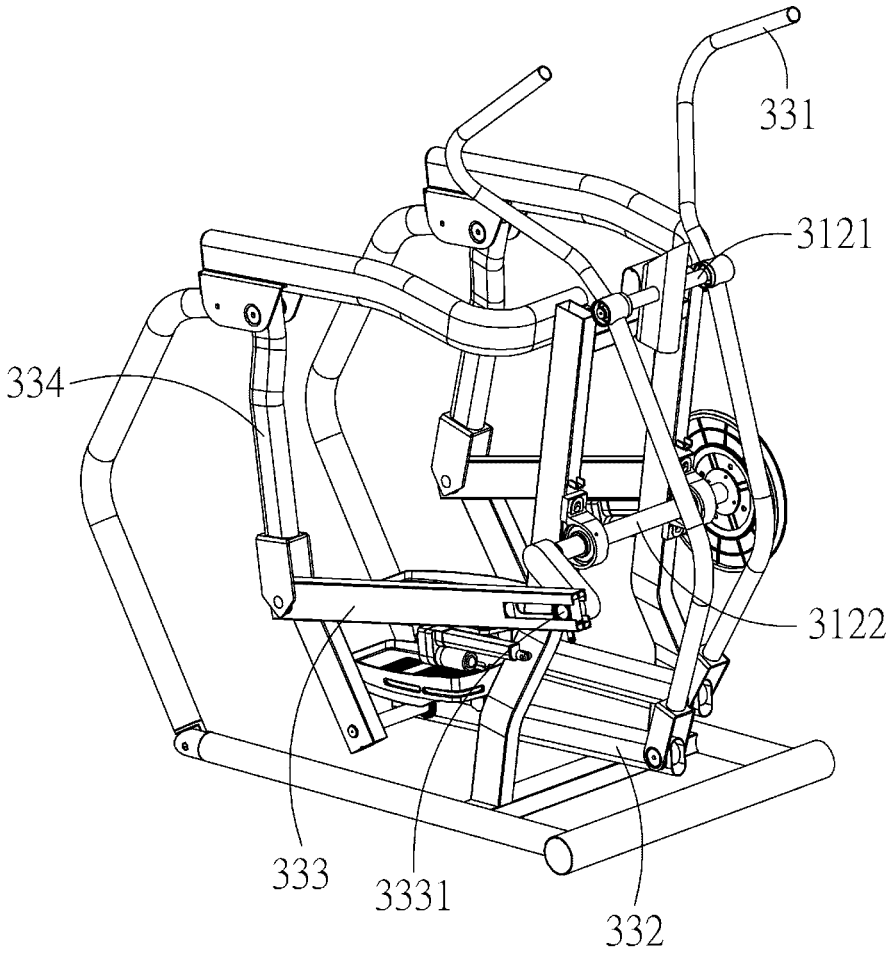
FIG. 3 is the first schematic diagram of the second embodiment of gait tread simulation fitness equipment of the present disclosure.
Figure 4:
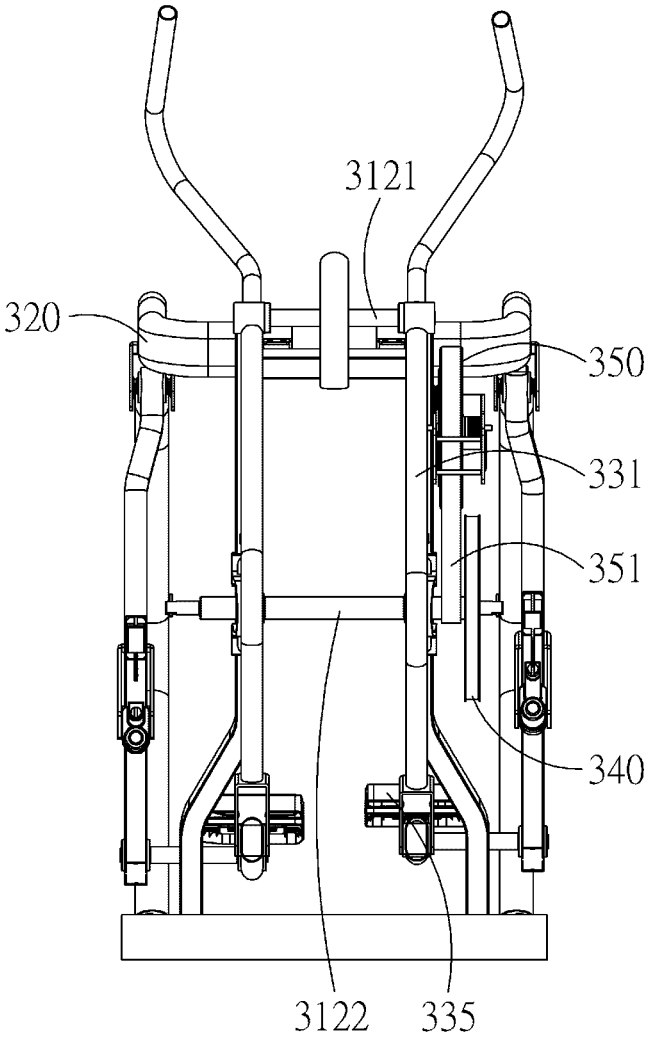
FIG. 4 is the second schematic diagram of the second embodiment of gait tread simulation fitness equipment of the present disclosure.

Please refer to FIG. 3 and FIG. 4, which are the first schematic diagram of the second embodiment of gait tread simulation fitness equipment of the present disclosure and the second schematic diagram of the second embodiment of gait tread simulation fitness equipment of the present disclosure, respectively. Please refer to FIG. 1 and FIG. 2 together. As shown in the figures, the same components of the gait tread simulation fitness equipment applied in the present embodiment have the same movement as that of the first embodiment. Hence, the unnecessary details are omitted herein. However, it has to be addressed that in the present embodiment the gait tread simulation fitness equipment 300 is preferably disposed with a drag force adjustment apparatus 350. The drag force adjustment apparatus 350 is disposed at one side of the central stand 312, and is connected to the second pivot 3122 through a strap member 351. When the drag force adjustment apparatus 350 is touched, it applies a drag force to the second pivot 3122 through the strap member 351 so as to reduce the speed when the tread rod 332 is reciprocating.

For example, the gait tread simulation fitness equipment 300 of the present disclosure is further disposed with the drag force adjustment apparatus 350. The drag force adjustment apparatus 350 is disposed at one side of the central stand 312, and is connected to the second pivot 3122 through the strap member 351. Hence, when the user touches the drag force adjustment apparatus 350 to increase the frictional force between the drag force adjustment apparatus 350 and the strap member 351 so as to apply a drag force to the second pivot 3122, the user has to increase the leg strength to move the pedal 335, so that the purpose of training the leg muscle is achieved.

It is worth mentioning that the drag force adjustment apparatus 350 has multiple drag force sets. The user can apply different levels of drag forces to the second pivot 3122 according the multiple drag force sets. Here, the drag force mechanism is formed of a magnetic plate providing a drag force. The magnetic plate may be designed to be an electromagnet, a permanent magnet, or a magnetic reluctance plate. The electromagnetic magnetic plate controls the drag force by current, the permanent magnet plate adjusts the distance of the rotational spindle of the permanent magnet, and the magnetic reluctance plate is designed according the theory of electromagnetic effect and electromagnetic induction.

In practice, the suspending rod 334 further includes the position adjustment apparatus (not shown) used to adjust a relative position of the suspending rod 334. Besides, the position adjustment apparatus (not shown) is disposed on the suspending rod 334 to adjust the relative position of the suspending pivot 321 or the relative position of the third joint 3333. Here, the position adjustment apparatus may be a gear wheel and rack set.

Figure 5:
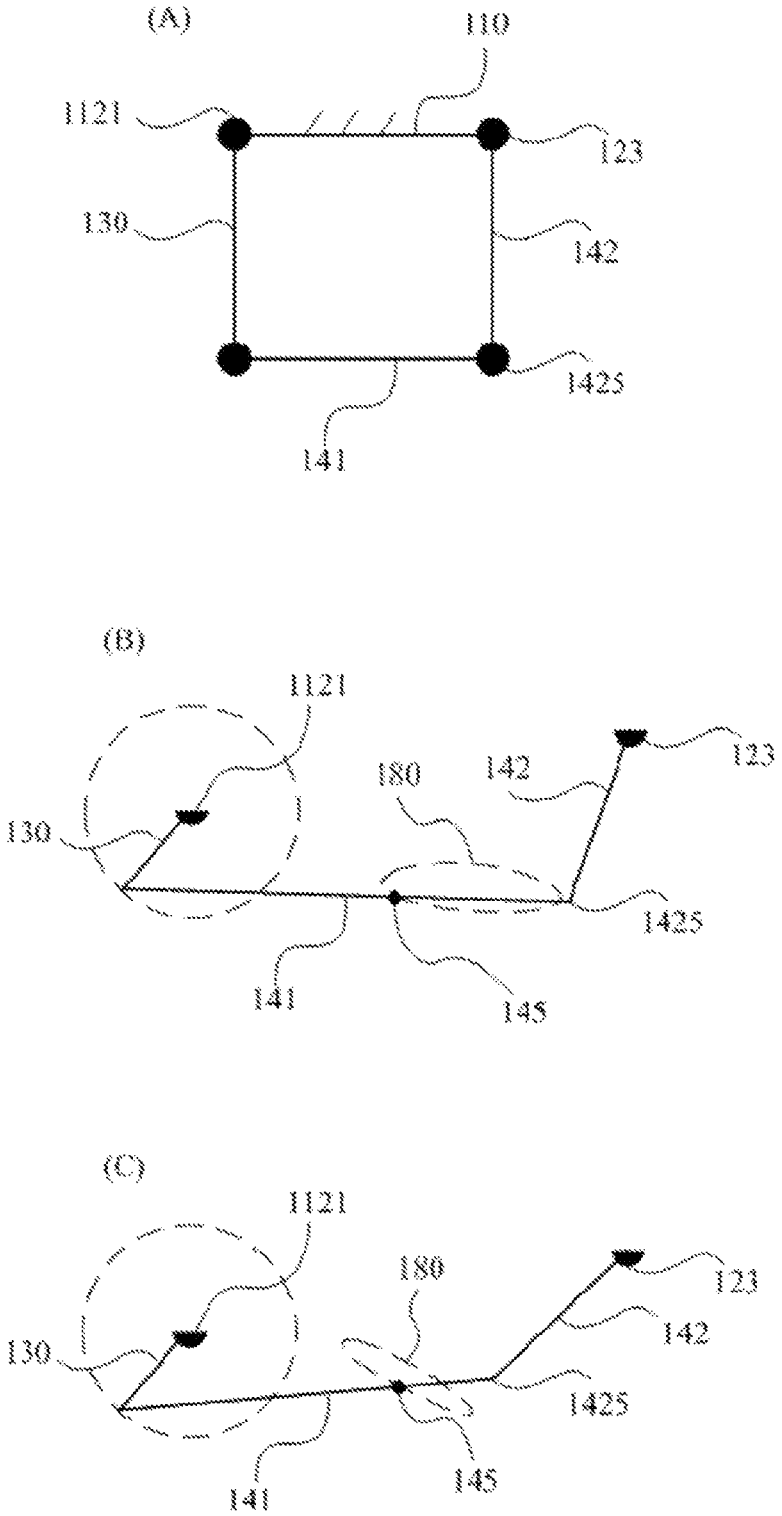
FIG. 5 is a brief diagram showing the mechanism of the third embodiment of gait tread simulation fitness equipment of the present disclosure.

Please refer to FIG. 5. As shown in part (A) of FIG. 5, the third embodiment of the present disclosure applies a four-bar linkage mechanism as the prototype. A main body 110 is served a fixed member, and a rotation mechanism 130 is disposed on a first pivot 1121, a suspending rod 142 is pivotally connected to a suspending pivot 123, and the active members of the rotation mechanism 130 and the suspending rod 142 are pivotally disposed at two ends of a tread rod 141 respectively. A pedal 145 is disposed on the tread rod 141, and the suspending rod 142 and the tread rod 141 are pivotally connected on a movable pivot 1425. By adjusting the rod length of at least one of the suspending rod 142 and the tread rod 141, a relative position of the movable pivot 1425 changes.

Furthermore, the rotation mechanism 130 having two active members performs a circular action through the first pivot 1121. In practice, the rotation mechanism 130 may be a crank or a flywheel mechanism. The suspending rod 142 is pivotally connected to the suspending pivot 123 to be swung back and forth. Hence, it can be found that the four-bar linkage mechanism of the present embodiment is a crank set.

As shown in part (B) of FIG. 5, when the rotation mechanism 130 is acting along the circle track, the pedal 145 disposed on the tread rod 141 acts along an elliptical closed track 180 to enable user performing the tread training. As to part (C) of FIG. 5, it shows that when the length of the linkage of the tread rod 141 is adjusted, the closed track 180 produces various included angles so as to further change the exercise type. The present embodiment shows that the type of the closed track 180 of the pedal 145 can be changed by adjusting the length of the tread rod 141.

The third embodiment applies a four-bar mechanism. It is known that the exercise type is able to be adequately adjusted by adjusting the relative position of the movable pivot 1425. However, the limitations of the rods of the mechanism may interfere with the flexibility of the closed trace 180 and the natural gait tread.

Figure 6:
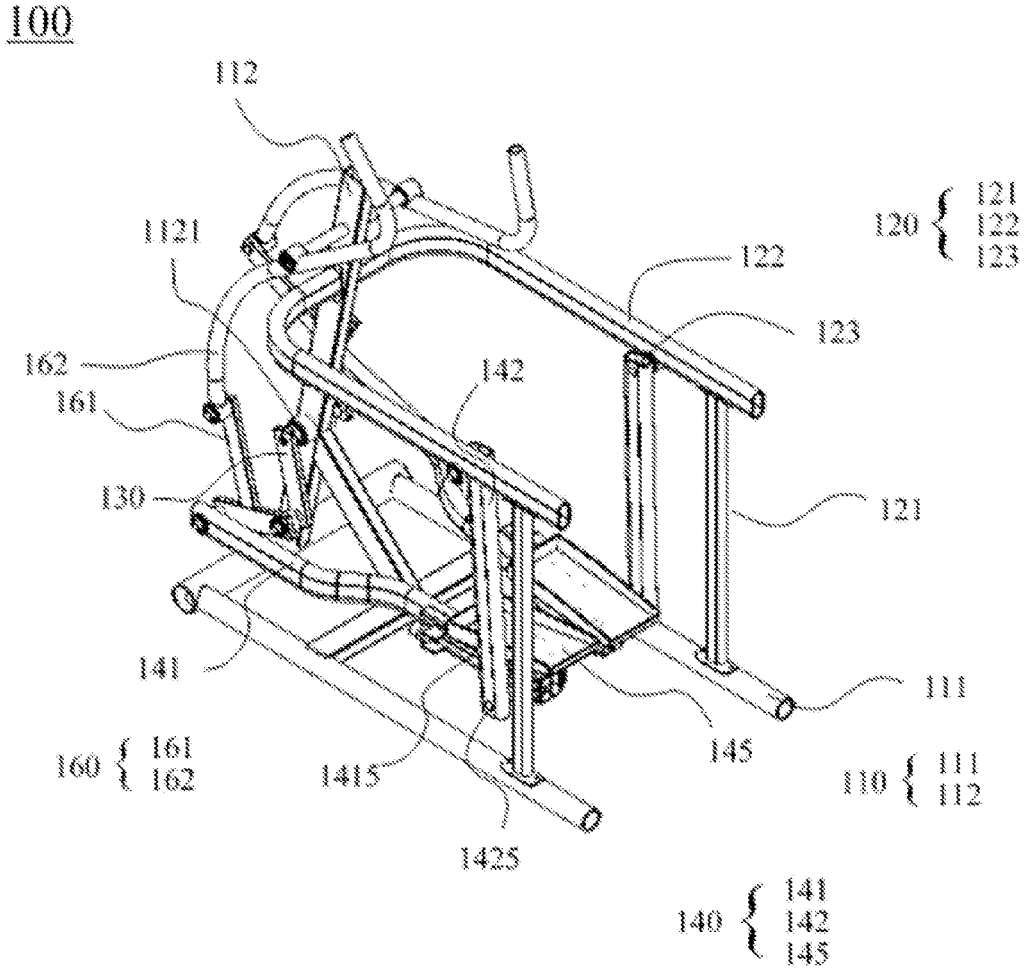
FIG. 6 is a schematic diagram of the fourth embodiment of gait tread simulation fitness equipment of the present disclosure.

Please refer to FIG. 6. The fourth embodiment further apples a linkage unit 160 having a triple-joint link 161 and a double-joint link 162 on the basis of the third embodiment. A Stephenson six-bar linkage comprised of the linkage unit 160, the rotation mechanism 130 and the guiding mechanism 140 facilitates the exercise track matching the natural gait tread.

It can be found though FIG. 6 that gait tread simulation fitness equipment 100 includes the main body 110, the suspending side frame 120 that is disposed correspondingly, the rotation mechanism 130 and the guiding mechanism 140. The main body 110 has a support frame 111, and a central stand 112 disposed at a front end of the support frame 111 and having a first pivot 1121. Two suspending side frames 120 are respectively disposed at two sides of the main body 110 and each suspending side frame 120 may be disposed with a suspending pivot 123. In practice, the suspending side frame 120 includes a vertical rod 121, a horizontal rod 122 or a combination thereof. The suspending side frame 120 may be designed according to the actual requirements, supporting strength, and so on. For example, the vertical rod 121 applied in the present embodiment is able to be disposed vertically at the rear end of the support frame 111, and the horizontal rod 122 may extend forwardly to connect to the central stand 112. Wherein, apart from sharing the loading of the support, the horizontal rod 122 is able to be designed according to actual requirements.

Two active members of the rotation mechanism 130 are disposed at two sides of the first pivot 1121 correspondingly by 180°. Two guiding mechanisms 140 are connected pivotally at two sides of the central stand respectively. Each guiding mechanism 140 includes the tread rod 141 and the suspending rod 142, the active member of the rotation mechanism 130 and the suspending rod 142 that are at the same side are connected by the tread rod 141. One end of the suspending rod 142 is connected pivotally to the suspending pivot 123, the other end of the suspending rod 142 and the tread rod 141 are connected pivotally to the movable pivot 1425, and the pedal 145 is disposed on the tread rod 141. When the pedal is treaded, the pedal 145 is actuated along the closed track 180 to enable the guiding mechanism being drawn back and forth. Wherein adjusting at least one rod length of the suspending rod 142 and tread rod 141 is able to change a relative position of the movable pivot 1425 so as to facilitate the close track 180 matching the natural gait tread.

In practice, the tread rod 141 further includes a stretching apparatus 1415 to adjust the relative position of the movable pivot 1425. The stretching apparatus 1415 includes a single-stroke stretching apparatus, a multiple-stroke stretching apparatus or a linear actuator. Similarly, the suspending rod 142 further includes a length adjustment apparatus to adjust the relative position of the suspending rod 142. Moreover, a position adjustment apparatus (not shown) may be disposed on the suspending rod 142 to adjust the relative position of the suspending pivot 123 or the relative position of the movable pivot 1425. The position adjustment apparatus may be a gear wheel and rack set.

Figure 7:
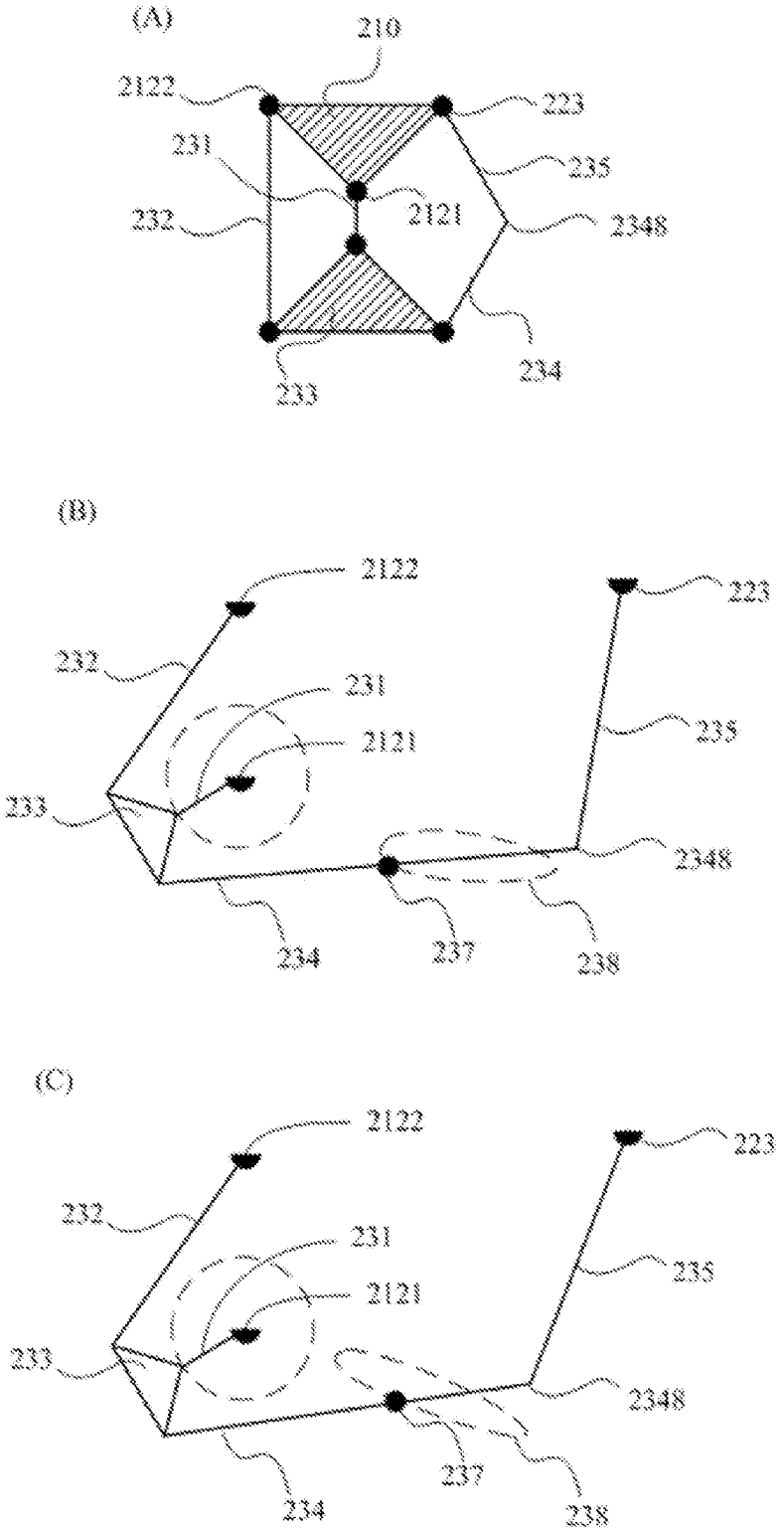
FIG. 7 is a brief diagram showing the mechanism of the fifth embodiment of gait tread simulation fitness equipment of the present disclosure.
Figure 8:
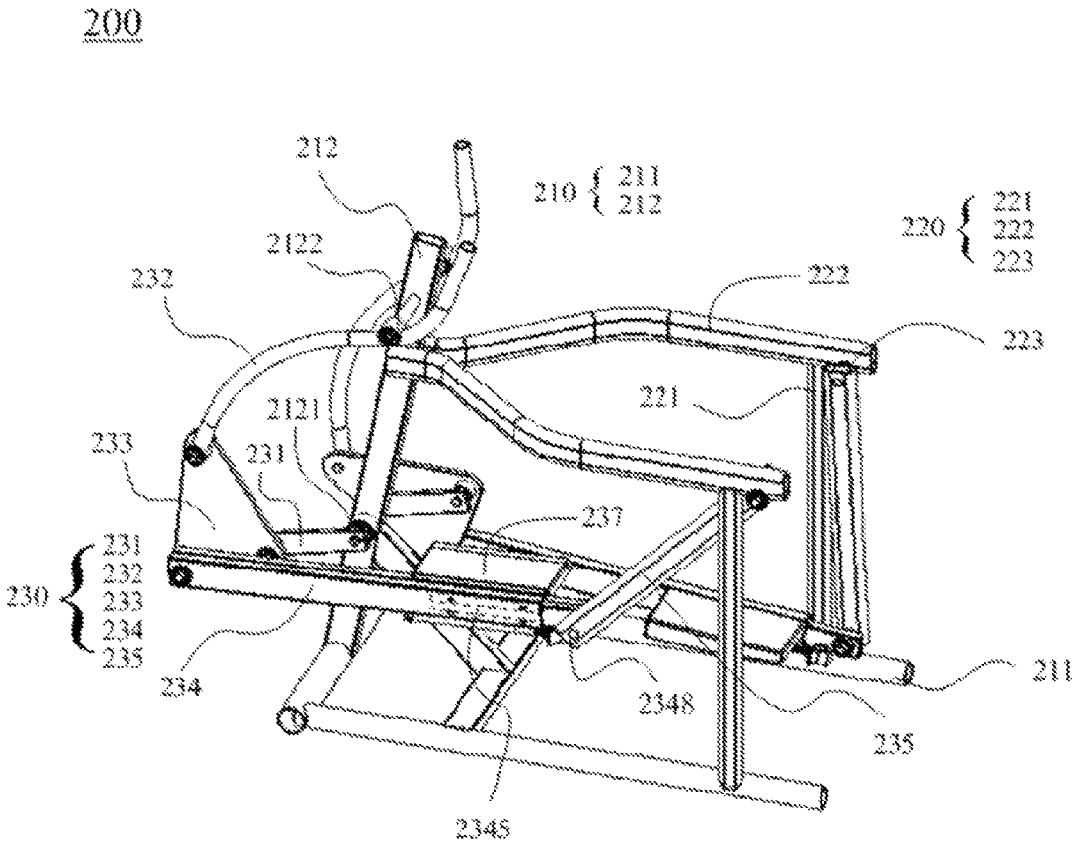
FIG. 8 is a schematic diagram of the fifth embodiment of gait tread simulation fitness equipment of the present disclosure.
Figure 9:
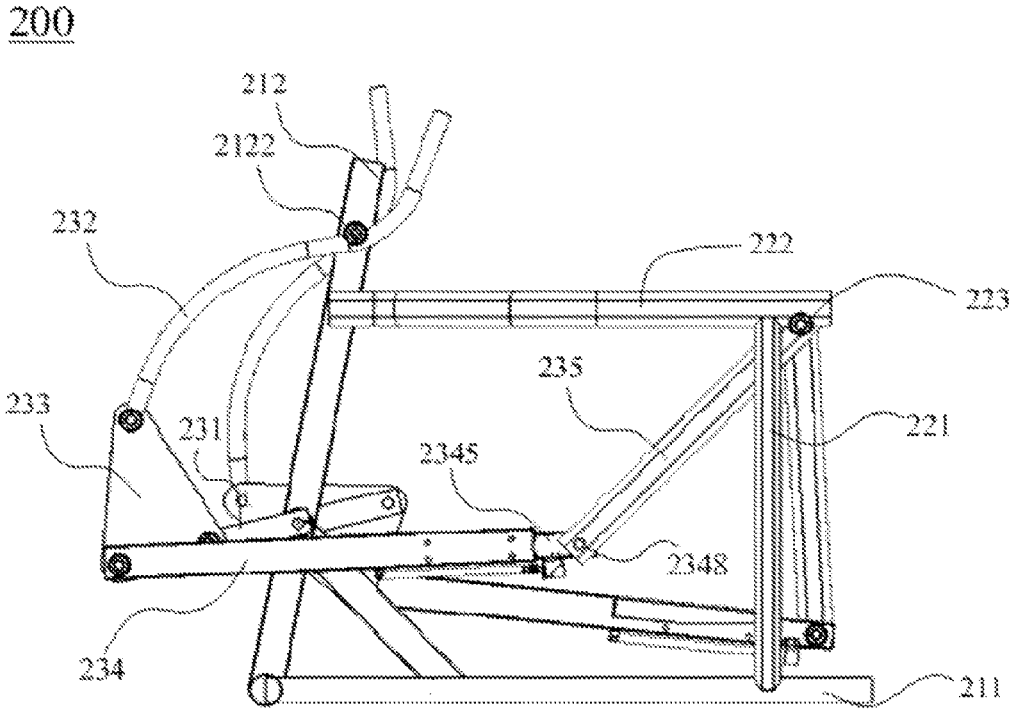
FIG. 9 is a front view of the fifth embodiment of gait tread simulation fitness equipment of the present disclosure.
Figure 10:
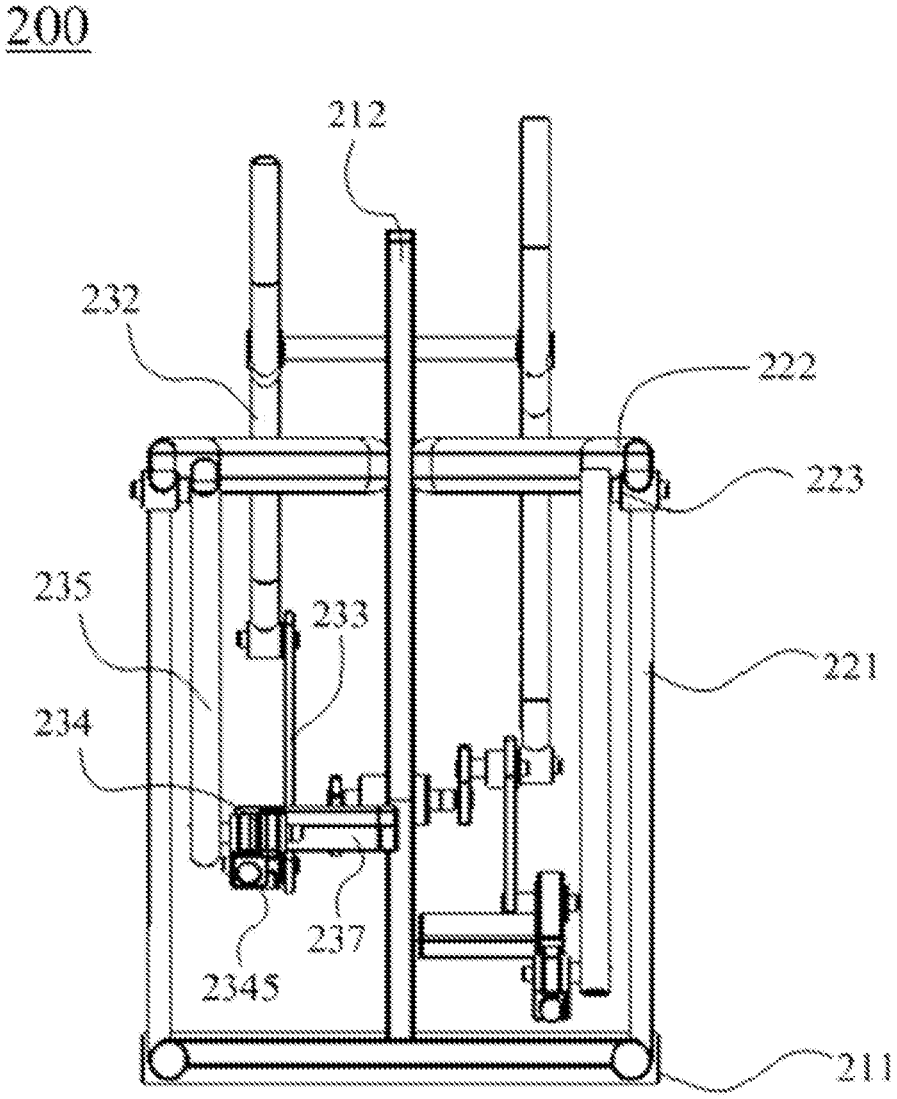
FIG. 10 is a side view of the fifth embodiment of gait tread simulation fitness equipment of the present disclosure.
Figure 11:
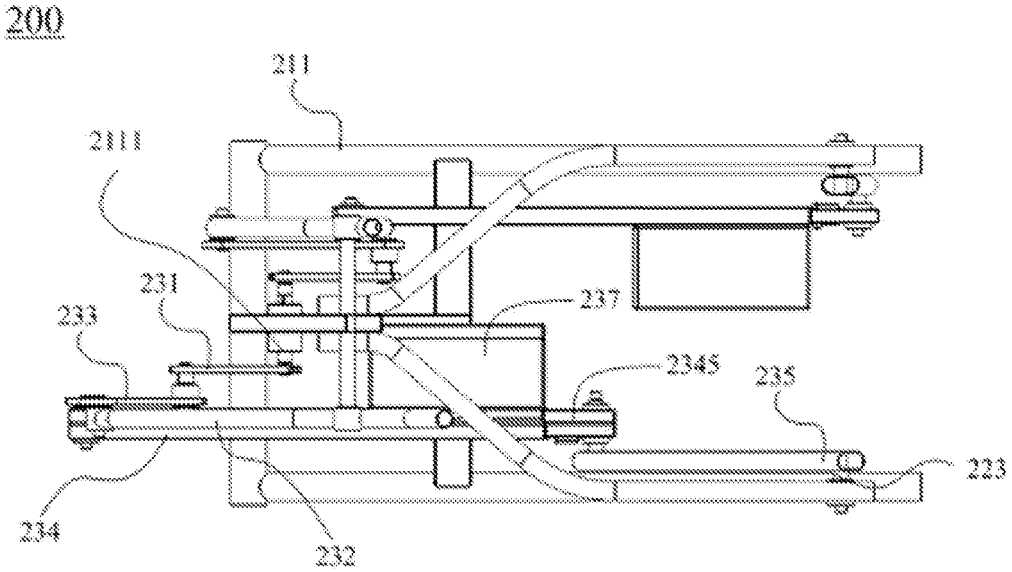
FIG. 11 is a top view of the fifth embodiment of gait tread simulation fitness equipment of the present disclosure.

Please refer to FIG. 7. For the sake of further designing gait tread fitness equipment to match ergonomics and be capable of simulating the natural gait tread, the gait tread simulation fitness equipment disclosed in the present disclosure applies the theory of the topology mechanism to choose the optimal type of the kinematic chain which fits into the exercise track, so as to further facilitate the action track of the pedal to match the natural gait tread.

The relative correlation among each linkage shown in part (A) of FIG. 7 and the simulation shown in parts (B) and (C) of FIG. 7 demonstrates the point which the exercise type can be changed easily and effectively by adjusting the length of the linkage or the position of the pivot.

Please refer to FIG. 7 and FIG. 8 to FIG. 11 together. The schematic diagram and each diagram of the fifth embodiment demonstrate clearly the relative correlation among each rod of the fifth embodiment.

The gait tread simulation fitness equipment 200 of the fifth embodiment includes the main body 210, the suspending side frames 220 that are disposed correspondingly and the guiding mechanism 230. The main body 210 has a support frame 211, and the central stand 212 disposed at a front end of the support frame 211 and having the first pivot 2121 and a second pivot 2122. Two suspending side frames 220 are respectively disposed at two sides of the main body 210 and each suspending side frame 220 is disposed with a suspending pivot 223. In practice, the suspending side frame 220 includes a vertical rod 221, a horizontal rod 222 or a combination thereof. The suspending side frame 220 may be designed according to the actual requirements, supporting strength, and so on. For example, the vertical rod 221 applied in the present embodiment is able to be disposed vertically at the rear end of the support frame 211, and the horizontal rod 222 may extend forwardly to connect to the central stand 212. Wherein apart from sharing the loading of the support, the horizontal rod 222 is able to be designed according to actual requirements as well.

Two guiding six-bar mechanisms 230 are respectively disposed at two sides of the central stand 212, each of the guiding mechanisms 230 is disposed at the first pivot 2121 and the suspending pivot 223 that are at the same side to form a constrained kinematic chain. Each guiding mechanism 230 includes a crank 231, a swing rod 232, a triple-joint link 233, a tread rod 234 and a suspending rod 235. Wherein the crank 231 is connected to the first pivot 2121 and the swing rod 232 is connected pivotally to the second pivot 2122 and extends to form a handle. One end of the suspending rod 235 is connected pivotally to the suspending pivot 223, and the other end of the suspending rod 235 and the tread rod 234 are connected pivotally to the movable pivot 2348. The triple-joint link 233 is respectively connected to the crank 231, the swing rod 232 and the tread rod 234. The triple-joint link 233 and the suspending rod 235 are connected by the tread rod 234, and the pedal 237 is disposed on the tread rod 234 to facilitate the pedal 237 actuating along the gait track 238.

To be more precise, when the crank 231 applies the first pivot 2121 as the circle center to rotate, acting the swing rod 232 and the tread rod 234 through the triple-joint link 233 while enabling the handle extended from the swing rod 232 being drawn back and forth is able to facilitate user's hand to simulate the natural swing. The pedal 237 is disposed on the tread rod 234, and through the correlation among each rod and the arrangement of the size, the gait track 238 is able to match the natural gait tread, such that each joint angle of the user's lower limbs may be not affected due to the action track of the pedal 237, and the risk of suffering from the sport injury is reduced greatly.

Furthermore, the first adjustment apparatus 2345 disposed on the tread rod 234 is able to change the length of the tread rod 234 or the position of the movable pivot 2348, so as to enable the gait track 238 producing various lifting angles and the ranges, such that the objectives of adjusting the slope, the gait tread, and the kinematic chain are able to be achieved. In practice, a third adjustment apparatus (not shown) may be disposed on the suspending rod 235. The action of the third adjustment apparatus is able to adjust the position of the suspending pivot 223 or the movable pivot 2348. In practice, the third adjustment apparatus may be a gear wheel and rack set.

Figure 12:
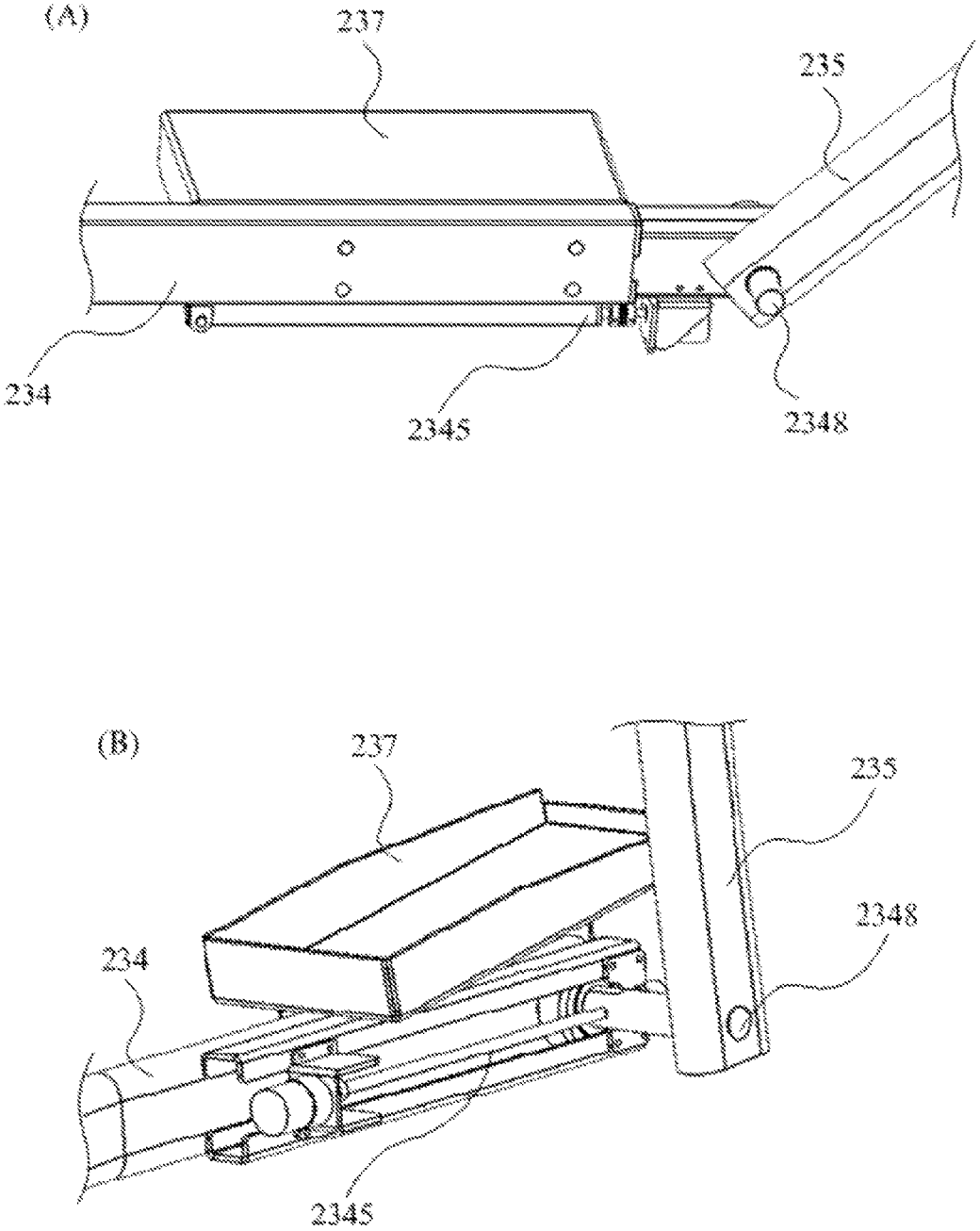
FIG. 12 is a schematic diagram of the first adjustment apparatus of the fifth embodiment of the third embodiment of gait tread simulation fitness equipment of the present disclosure.

Please refer to FIG. 12 which is a schematic diagram showing different aspect of the first adjustment apparatus. The first adjustment apparatus 2345 has various aspects. The positions of the movable pivot 2348 between the tread rod 234 and the suspending rod 235 which can be changed all belong to the applied aspect of the present disclosure. Here are several common used aspects for explaining, but not limited thereto. The tread rod 234 shown in part (A) of FIG. 12 is formed of an internal sleeve and an external sleeve which are sheathed and fixed with each other. Two ends of the first adjustment apparatus 2345 are respectively disposed on the internal sleeve and the external sleeve, and when the first adjustment apparatus 2345 is actuated to change the relative position of the internal sleeve and the external sleeve, the length of the tread rod 234 changes. The first adjustment apparatus 2345 may be a single-stroke stretching apparatus, a multiple-stroke stretching apparatus or an actuator. Another aspect shown in part (B) of FIG. 12 demonstrates that the first adjustment apparatus 2345 has roller and guiding rail set. The suspending rod 235 is connected pivotally to the roller to thereby change the position of the roller to correspond to the relative position of the movable pivot 2348, so as to change the exercise track.

Figure 13:
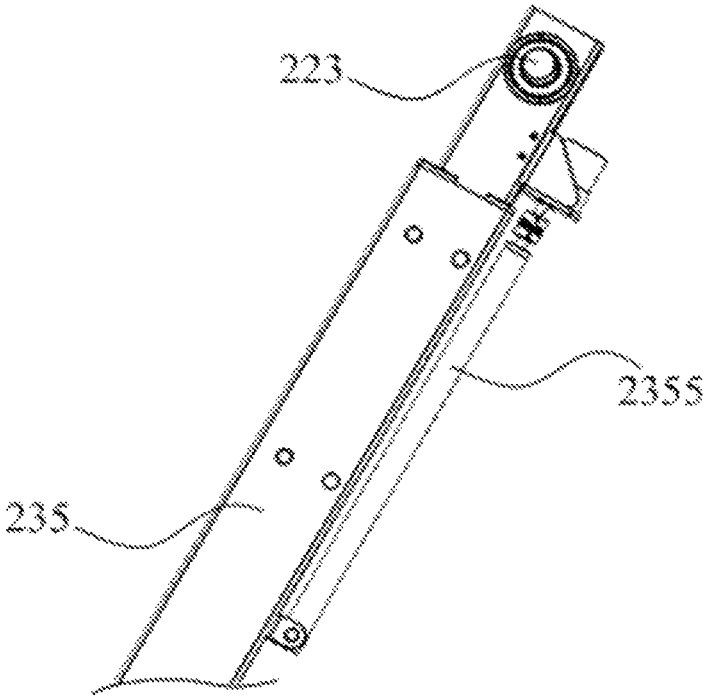
FIG. 13 is a schematic diagram of the second adjustment apparatus of the fifth embodiment of the third embodiment of gait tread simulation fitness equipment of the present disclosure.

Please refer to FIG. 13 which is a schematic diagram of the second adjustment apparatus. It can be found according to the aforementioned points that the relative position of each rod is changed so that the exercise track is changed. For example, the suspending rod 235 may be designed as an aspect of sleeve sheath to cooperate with the second adjustment apparatus to change the length of the suspending rod 235. The second adjustment apparatus 2355 includes various stretching apparatuses or linear actuators.

The range of the action of the first adjustment apparatus 2345 or that of the second adjustment apparatus 2355 has to satisfy with the size limitation of the linkage mechanism so as to satisfy with the exercise track of the natural gait tread. Applying the gait tread simulation fitness equipment 200 disclosed in the third embodiment to simulate and then analyze, it can be found that when the first adjustment apparatus 2345 is acting in a range of 0-40 cm, the gait tread range of the gait track 238 varies in a range of 45 cm-65 cm, the lifting angle of the gait track 238 varies in a range of 0°-20°, and the flat ratio of the long and short axis varies in a range of 8:1-3:1. Thus, it can be found through the preceding embodiments that the present disclosure is able to change different aspects of the exercise track such as the gait tread range, lifting angle, flat ratio, track smoothness, and so on to facilitate the exercise track matching the natural gait tread by adjusting the length of each rod to change the relative position of the pivot.

By adding the adjustment apparatuses, the objective of adjusting the exercise track is able to be achieved. Compared with the current various adjustment methods, the present disclosure indeed provides a relative inventive step and possesses flexibility of the adjustment method. Moreover, by means of the simple arrangement of the linkage mechanism, the related cost can be saved so as to promote the industrial benefit.

While the means of specific embodiments in present disclosure has been described by reference drawings, numerous modifications and variations could be made thereto by those skilled in the art without departing from the scope and spirit of the disclosure set forth in the claims. The modifications and variations should in a range limited by the specification of the present disclosure.

What is claimed is:

1. A gait tread simulation fitness equipment, comprising:

a main body, having a support frame, and a central stand disposed at a front end of the support frame and having a first pivot and a second pivot;

a plurality of suspending side frames respectively disposed at two sides of the main body and each suspending side frame disposed with a suspending pivot; and a plurality of guiding mechanisms respectively disposed at two sides of the central stand, each guiding mechanism comprising a swing rod, a tread rod, a triple-joint link and a suspending rod; the swing rod pivotally connected to one end of the first pivot, one end of the tread rod pivotally connected to the swing rod, the other end of the tread rod disposed with a pedal, a first joint of the triple-joint link connected to one end of the second pivot, a second joint of the triple-joint link connected to the tread rod, one end of the suspending rod pivotally connected to a third joint of the triple-joint link, and the other end of the suspending rod pivotally connected to the suspending pivot;

wherein, when the tread rod is reciprocating, the triple-joint link is driven by the tread rod to go around the second pivot so as to facilitate the pedal actuating along a gait track.

2. The gait tread simulation fitness equipment of claim 1, wherein the triple-joint link further comprises a stretching apparatus adjusting a length of the triple-joint link.

3. The gait tread simulation fitness equipment of claim 1, wherein the suspending rod further comprises a length adjustment apparatus adjusting a length of the suspending rod.

4. The gait tread simulation fitness equipment of claim 1, wherein the triple-joint link further comprises a position adjustment apparatus adjusting a relative position of the third joint of the triple-joint link.

5. The gait tread simulation fitness equipment of claim 1, wherein the suspending rod further comprises a position adjustment apparatus adjusting a relative position of the suspending pivot.

6. A gait tread simulation fitness equipment, comprising:

a main body, having a support frame, and a central stand disposed at a front end of the support frame and having a first pivot;

two suspending side frames respectively disposed at two sides of the main body and each suspending side frame disposed with a suspending pivot;

a rotation mechanism having two active members disposed at two sides of the first pivot correspondingly and rotated about the first pivot respectively; and two guiding mechanisms connected pivotally at two sides of the central stand respectively, each guiding mechanism comprising a tread rod and a suspending rod, the active member of the rotation mechanism and the suspending rod that are at the same side connected by the tread rod, one end of the suspending rod connected pivotally to the suspending pivot, the other end of the suspending rod and the tread rod connected pivotally to a movable pivot, and a pedal disposed on the tread rod; when the pedal is treaded, the pedal is actuated along a closed track to enable the guiding mechanism to be drawn back and forth, wherein a distance of the suspending pivot relative to the movable pivot is adjusted, or a distance of the movable pivot relative to the pedal is changed to facilitate the closed track to match a natural gait tread.

7. The gait tread simulation fitness equipment of claim 6, further comprising a linkage unit having a triple-joint link and a double-joint link; wherein a Stephenson six-bar linkage is comprised of the linkage unit, the rotation mechanism and the guiding mechanism.

8. A gait tread simulation fitness equipment, comprising:

a main body, having a support frame, and a central stand disposed at a front end of the support frame and having a first pivot and a second pivot;

two suspending side frames respectively disposed at two sides of the main body and each suspending side frame disposed with a suspending pivot; and two guiding mechanisms respectively disposed at two sides of the central stand, each of the guiding mechanisms disposed at the first pivot and the suspending pivot that are at the same side to form a constrained kinematic chain; each guiding mechanism comprising a crank, a swing rod, a triple-joint link, a tread rod and a suspending rod; wherein the crank is connected pivotally to the first pivot, the swing rod is connected pivotally to the second pivot and extends to form a handle, one end of the suspending rod is connected pivotally to the suspending pivot, the other end of the suspending rod and the tread rod are connected pivotally to a movable pivot, the triple-joint link is respectively connected to the crank, the swing rod and the tread rod, the triple-joint link and the suspending rod are connected by the tread rod, and a pedal is disposed on the tread rod to facilitate the pedal actuating along a gait track.

9. The gait tread simulation fitness equipment of claim 8, wherein the tread rod further comprises a first adjustment apparatus adjusting a length of the tread rod or a relative position of the movable pivot so as to further change an aspect of the gait track.

10. The gait tread simulation fitness equipment of claim 8, wherein the suspending rod further comprises a second adjustment apparatus and a third adjustment apparatus; the second adjustment apparatus adjusts a length of the suspending rod so as to further change an aspect of the gait track, and the third adjustment apparatus adjusts a relative position of the suspending pivot.

* * * * *